US010003879B2

(12) United States Patent
Yang

(10) Patent No.: US 10,003,879 B2
(45) Date of Patent: Jun. 19, 2018

(54) EARPHONE WITH EXPANDING SPEAKER DEVICE

(71) Applicant: HTC Corporation, Taoyuan (TW)

(72) Inventor: Hsiu-Po Yang, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days. days.

(21) Appl. No.: 15/653,554

(22) Filed: Jul. 19, 2017

(65) Prior Publication Data

US 2018/0027319 A1 Jan. 25, 2018

Related U.S. Application Data

(60) Provisional application No. 62/365,363, filed on Jul. 21, 2016.

(51) Int. Cl.

| | |
|---|---|
| ***H04R 1/10*** | (2006.01) |
| ***H04R 1/24*** | (2006.01) |
| ***H04R 1/02*** | (2006.01) |
| ***H04R 1/26*** | (2006.01) |
| *H04R 1/28* | (2006.01) |

(52) U.S. Cl.

CPC ..... *H04R 1/1016* (2013.01); *H04R 1/023* (2013.01); *H04R 1/1075* (2013.01); *H04R 1/24* (2013.01); *H04R 1/26* (2013.01); *H04R 1/2811* (2013.01); *H04R 2201/107* (2013.01)

(58) Field of Classification Search

CPC ..... H04R 1/10; H04R 1/1016; H04R 1/1058; H04R 1/1066; H04R 1/1075; H04R 1/24; H04R 1/2811

USPC ..... 381/380, 384

See application file for complete search history.

(56) References Cited

U.S. PATENT DOCUMENTS

2006/0251282 A1* 11/2006 Kaoh ..... H04R 1/083 381/381
2009/0175473 A1* 7/2009 Wong ..... H04R 1/1075 381/309
2010/0166237 A1* 7/2010 Leeper ..... H04R 5/04 381/309
2014/0192996 A1* 7/2014 Wilcox ..... H04M 1/05 381/77

* cited by examiner

*Primary Examiner* — Katherine Faley
(74) *Attorney, Agent, or Firm* — JCIPRNET

(57) ABSTRACT

An earphone apparatus includes at least one sound broadcasting device. Each of the sound broadcasting device includes a main shell, a plurality of first electrodes, a speaker device and an expanding speaker device. The main shell has a first connector. The speaker device is disposed in the main shell, and receives a sound signal through a signal transmitting wire coupled to the first electrodes. The expanding speaker device has a second connector, and the expanding speaker device is detachably connected to the first connector through the second connector. When the second connector is connected to the first connector, the expanding speaker device is electronically connected to the first electrodes, and receives the sound signal transmitted by the signal transmitting wire.

9 Claims, 7 Drawing Sheets

EARPHONE WITH EXPANDING SPEAKER DEVICE

CROSS REFERENCE TO RELATED APPLICATION

This application claims the priority benefit of U.S. provisional application Ser. No. 62/365,363, filed on Jul. 21, 2016. The entirety of the above-mentioned patent application is hereby incorporated by reference herein and made a part of specification.

BACKGROUND OF THE INVENTION

1. Field of the Invention

The invention relates to an earphone apparatus, and particularly relates to an expandable multiple audio frequency earphone apparatus.

2. Description of Related Art

With the advancement of electronic technologies, electronic apparatuses have become an indispensable tool of our daily lives. Among the electronic apparatuses nowadays, whether an electronic apparatus provides a satisfactory audio-visual playing function is an important factor in determining whether such electronic apparatus is competitive on the market.

Regarding sound playing, various ways have been adopted to improve audio effect and quality in the conventional art. Nevertheless, the structures of conventional earphone apparatuses are normally fixed. Thus, the user has to purchase and carry around earphone apparatuses with different effects when having different needs. Therefore, the expense is higher and the use of the earphone apparatuses is not convenient, either.

SUMMARY OF THE INVENTION

The invention provides an earphone apparatus rendering a desirable audio quality through a detachable mechanism.

An earphone apparatus according to an embodiment of the invention includes at least one sound broadcasting device, and each of the sound broadcasting device includes a main shell, a plurality of first electrodes, a speaker device, and an expanding speaker device. The main shell has a first connector. The first electrodes are disposed on the first connector. The speaker device is disposed in the main shell, and receives a sound signal through a signal transmitting wire coupled to the first electrodes. The expanding speaker device has a second connector, and the expanding speaker device is detachably connected to the first connector through the second connector. When the second connector is connected to the first connector, the expanding speaker device is electronically connected to the first electrodes, and receives the sound signal transmitted by the signal transmitting wire.

According to an embodiment of the invention, the expanding speaker device further includes a plurality of second electrodes. When the second connector is connected to the first connector, the first electrodes are electronically coupled to the second electrodes.

According to an embodiment of the invention, the first connector has a first alignment structure, and the second connector has a second alignment structure. The first electrodes are disposed in correspondence with the first alignment structure, and the second electrodes are disposed in correspondence with the second alignment structure. In addition, when the second connector is connected to the first connector, the first alignment structure corresponds to the second alignment structure to electronically couple the first electrodes to the second electrodes respectively.

According to an embodiment of the invention, the expanding speaker device further includes an expanding shell. When the second connector is connected to the first connector, the expanding shell and the main shell form a resonance space.

According to an embodiment of the invention, the main shell further includes a detachable cover. When the second connector is physically isolated from the first connector, the detachable cover keeps the main shell closed through the first connector.

According to an embodiment of the invention, the main shell further includes a third connector disposed on the main shell relative to the first connector. The earphone apparatus further includes an expanding shell. The expanding shell is connected to the main shell through the third connector and the expanding shell and the main shell form another resonance space.

According to an embodiment of the invention, the earphone apparatus further includes a microphone disposed in the main shell.

According to an embodiment of the invention, the first electrodes include a first positive electrode and a first negative electrode. The first positive electrode receives a positive part signal of the sound signal, and the first negative electrode receives a negative part signal of the sound signal. The second electrode includes a second positive electrode and a second negative electrode. The second positive electrode receives the positive part signal of the sound signal, and the second negative electrode receives the negative part signal of the sound signal.

According to an embodiment of the invention, a working frequency band of the expanding speaker device is different from a working frequency band of the speaker device.

According to an embodiment of the invention, the expanding speaker device is a tweeter or a woofer.

Based on the above, the embodiments of the invention provide the detachable earphone apparatus. By detachably assembling or removing the expanding speaker device to or from the earphone apparatus with the normal speaker device, the earphone apparatus is able to play sounds in a single frequency band or in multiple frequency bands, thereby facilitating the sound playing quality available.

In order to make the aforementioned and other features and advantages of the invention comprehensible, several exemplary embodiments accompanied with figures are described in detail below.

DESCRIPTION OF THE EMBODIMENTS

Figure 1:
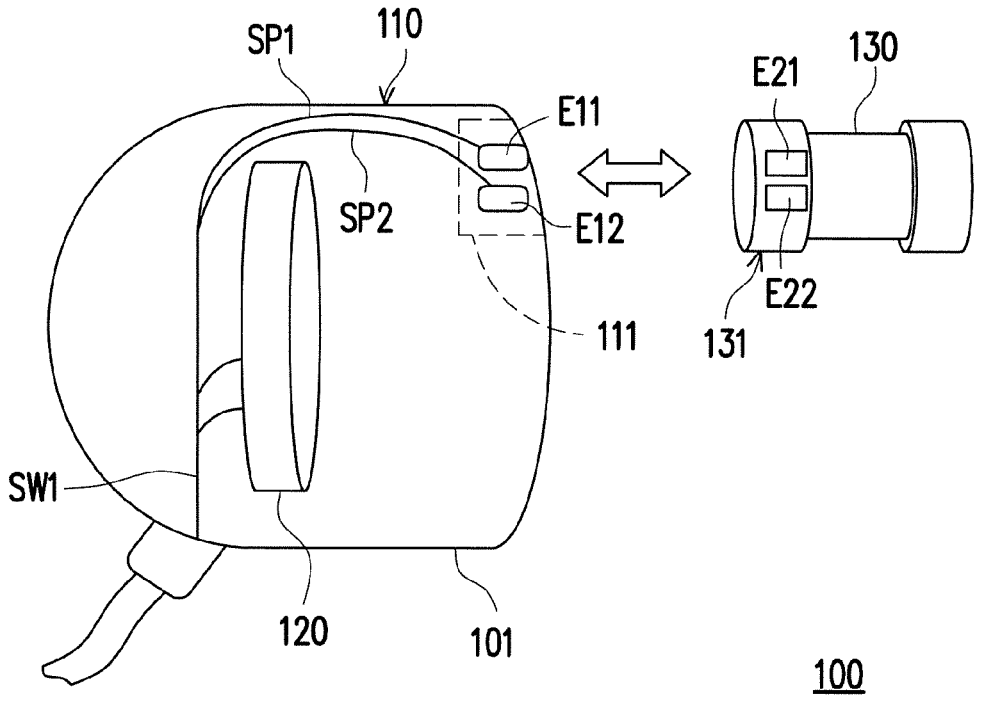
FIG. 1 is a schematic view illustrating an earphone apparatus according to an embodiment of the invention.

Referring to FIG. 1, FIG. 1 is a schematic view illustrating an earphone apparatus according to an embodiment of the invention. An earphone apparatus 100 includes at least one sound broadcasting device. A sound broadcasting device 101 includes a main shell 110, first electrodes E11 and E12, a speaker device 120, and an expanding speaker device 130. The speaker device 120 is a speaker device whose working frequency band is a normal frequency band. The speaker device 120 is disposed inside the main shell 110, and is electronically connected to a signal transmitting wire SW1 to receive a sound signal through the signal transmitting wire SW1.

Moreover, the main shell 110 has a connector 111. The first electrodes E11 and E12 are disposed on the connector 111. In addition, the first electrodes E11 and E12 are respectively electronically connected to signal transmitting wires SP1 and SP2 in the signal transmitting wire SW1. Besides, the expanding speaker device 130 has a connector 131, and second electrodes E21 and E22 are disposed on the connector 131. It should be noted that the expanding speaker device 130 is detachably connected to the connector 111 through the connector 131. In addition, when the connector 131 is connected to the connector 111, the second electrodes E21 and E22 on the connector 131 are respectively electronically connected to the first electrodes E11 and E12 on the connector 111. Accordingly, the expanding speaker device 130 may receive the sound signal transmitted by the signal transmitting wire SW1 through the second electrodes E21 and E22 and the first electrodes E11 and E12 and play a sound accordingly.

Here, the first electrodes E11 and E12 may respectively be an electrode of positive polarity and an electrode of negative polarity, and the second electrodes E21 and E22 may respectively be an electrode of positive polarity and an electrode of negative polarity. In addition, the signal transmitting wires SP1 and SP2 respectively transmit a signal of positive polarity and a signal of negative polarity in the sound signal.

In the embodiment, the speaker device 120 and the expanding speaker device 130 may be speaker devices with different working frequency bands. Specifically, the speaker device 120 may be a speaker device whose working frequency band is a normal frequency band of audible sounds, and the expanding speaker device 130 may be a tweeter whose working frequency band is relatively higher or a woofer whose working frequency band is relatively lower. Hence, according to the embodiment of the invention, when the user wishes to perceive an effect of sounds in a greater number of frequency bands (e.g., listening to music), the expanding speaker device 130 may be connected to the earphone apparatus 100 to expand the sound effect that the earphone apparatus 100 is able to present. Alternatively, when the user only needs to perceive a relatively monotonic sound effect (e.g., listening to a speech), the expanding speaker device 130 may be removed.

It should be noted that, in the embodiment, through a structural design, the first electrodes E11 and E12 may form effective electronic connection with the second electrodes E21 and E22 respectively after the connector 111 and the connector 131 are stably connected, and thus provide a stable transmission path for the sound signal. The connector 111 and the connector 131 may be designed to be connectors in a spiral shape (such as a screw and a nut). Alternatively, the connector 111 and the connector 131 may also be designed to be connectors with a magnetic force to form connection through magnetic attraction. In addition, the first electrodes E11 and E12 and the second electrodes E21 and E22 may be arranged at suitable positions, and the first electrodes E11 and E12 and the second electrodes E21 and E22 may contact each other after the connector 131 is screwed into and tightly connected to the connector 111 to form a desirable electronic coupling state.

Of course, in another embodiment of the invention, the connector 111 and the connector 131 may also be disposed as a male connection head and a female connection head (or a female connection head and a male connection head), and when the connector 113 is inserted into the connector 111, the first electrodes E11 and E12 may respectively contact the second electrodes E21 and E22 to form electronic coupling.

It should be noted that, when the connector 111 is connected to the connector 131, to ensure that the first electrodes E11 and E12 are respectively electronically coupled to the second electrodes E21 and E22, a fool-proof design may be adopted in the connector 111 and the connector 131. In brief, the connector 111 and the connector 131 may be arranged as connection heads in special asymmetrical shapes, for example. Accordingly, when the connector 111 is connected to the connector 131, a relative position relation between the connector 111 and the connector 131 is fixed to ensure that the first electrodes E11 and E12 and the second electrodes E21 and E22 are in the electronic coupling state.

It should also be noted that, in some embodiments of the invention, a microphone (not shown) may be disposed in the earphone apparatus 100, such as being disposed in the main shell 110.

Figure 2A:
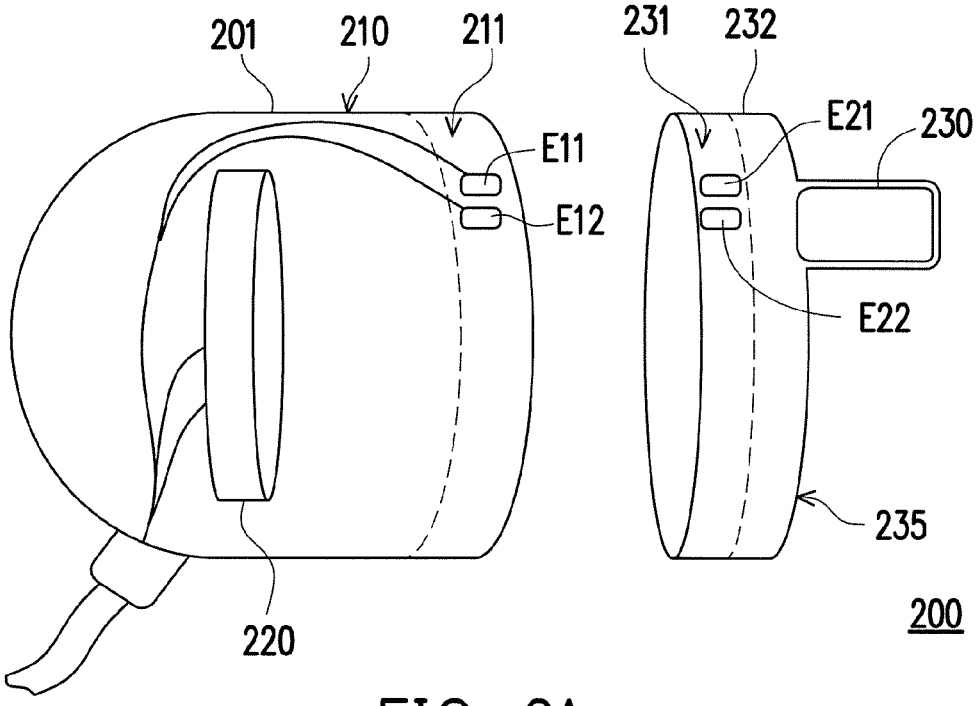
FIGS. 2A and 2B are schematic views illustrating an earphone apparatus according to another embodiment of the invention.
Figure 2B:
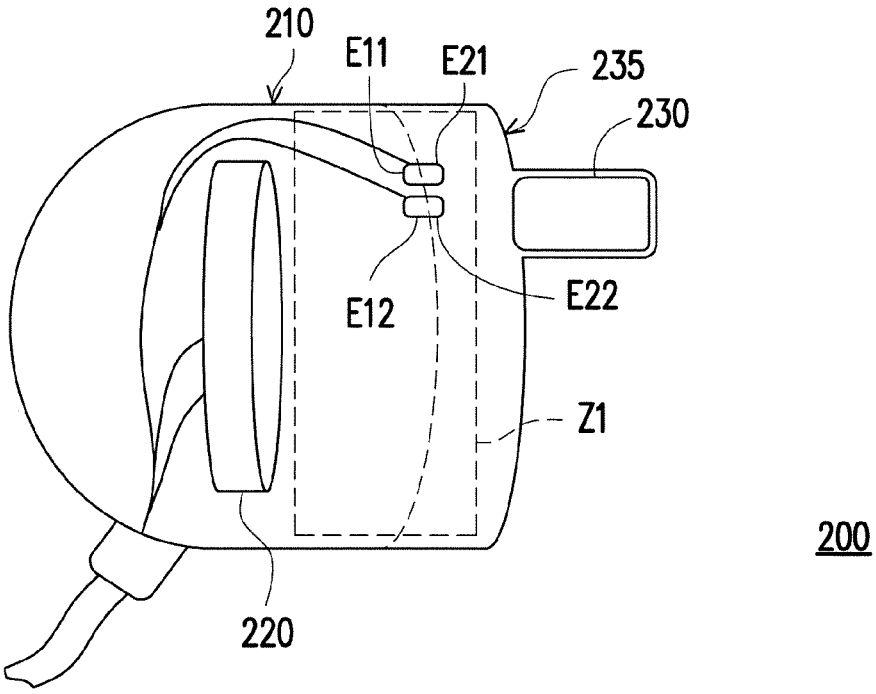

Referring to FIGS. 2A and 2B, FIGS. 2A and 2B are schematic views illustrating an earphone apparatus according to another embodiment of the invention. An earphone apparatus 200 includes a sound broadcasting device 201. The sound broadcasting device 201 includes a main shell 210, a speaker device 220, and an expanding speaker device 230. The main shell 210 has a connector 211, and the first electrodes E11 and E12 are disposed on the connector 211. The expanding speaker device 230 has an expanding shell 235 and a connector 231 disposed on the expanding shell 235. In addition, the second electrodes E21 and E22 of the expanding speaker device 230 are disposed on the connector 231. When the connector 231 of the expanding speaker device 230 is connected to the connector 211 on the main shell 210, the first electrodes E11 and E12 may be electronically coupled to the second electrodes E21 and E22 respectively.

FIG. 2A illustrates a state when the expanding speaker device 230 is physically isolated from the main shell 210. In the state, the expanding speaker device 230 does not receive the sound signal and does not play a sound. Comparatively, in FIG. 2B, the expanding speaker device 230 and the main shell 210 are connected to each other through the connectors 211 and 231. In addition, the first electrode E11 contacts the second electrode E21 and the first electrode E12 contacts the second electrode E22 to form the electronic coupling state. Accordingly, the sound signal is simultaneously transmitted to the speaker device 210 and the expanding speaker device 230 to play sounds in multiple frequency bands.

It should also be noted that, in the embodiment, by disposing the expanding shell 235 in the expanding speaker device 230, the main shell 210 and the expanding shell 230 may form a resonance space Z1 when the expanding speaker device 230 is connected to the main shell 210. By enlarging the resonance space Z1 of the earphone apparatus 200, a sound quality rendered by the earphone apparatus 200 may be further facilitated.

It should also be noted that the expanding shell 235 may be designed to exhibit different colors, shapes and patterns based on the user's preference. The user may purchase the expanding speaker device 230 based on a preferred style of the expanding shell 235. Therefore, the earphone apparatus 200 may become more competitive as a product.

Figure 3A:
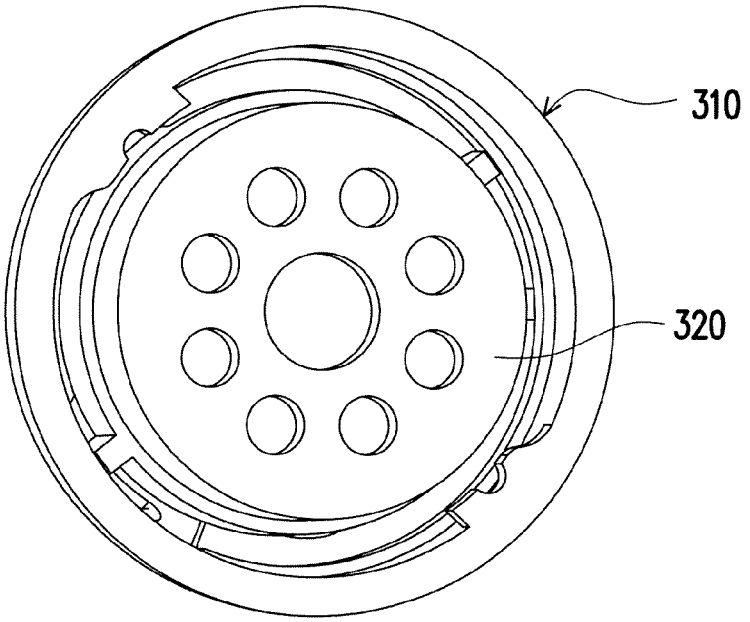
FIGS. 3A and 3B are schematic views illustrating a structure of an earphone apparatus according to an embodiment of the invention.
Figure 3B:
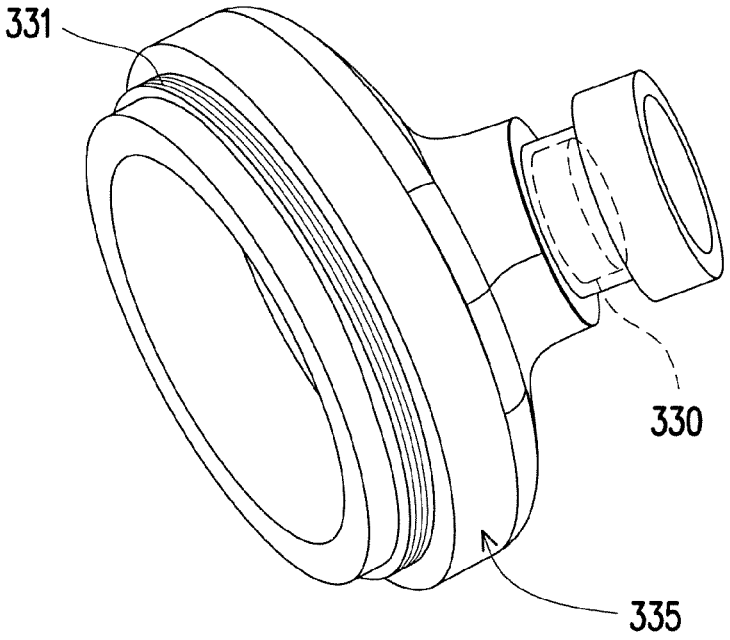

Referring to FIGS. 3A and 3B, FIGS. 3A and 3B are schematic views illustrating a structure of an earphone apparatus according to an embodiment of the invention. In FIG. 3A, a speaker device 320 is disposed in a main shell 310. In FIG. 3B, an expanding speaker device 330 has an expanding shell 335, and a screw-patterned connector 331 is disposed on the expanding shell 335. The expanding speaker device 330 may be locked to the main shell 310 by being screwed into the main shell 310 through the connector 331.

Figure 3C:
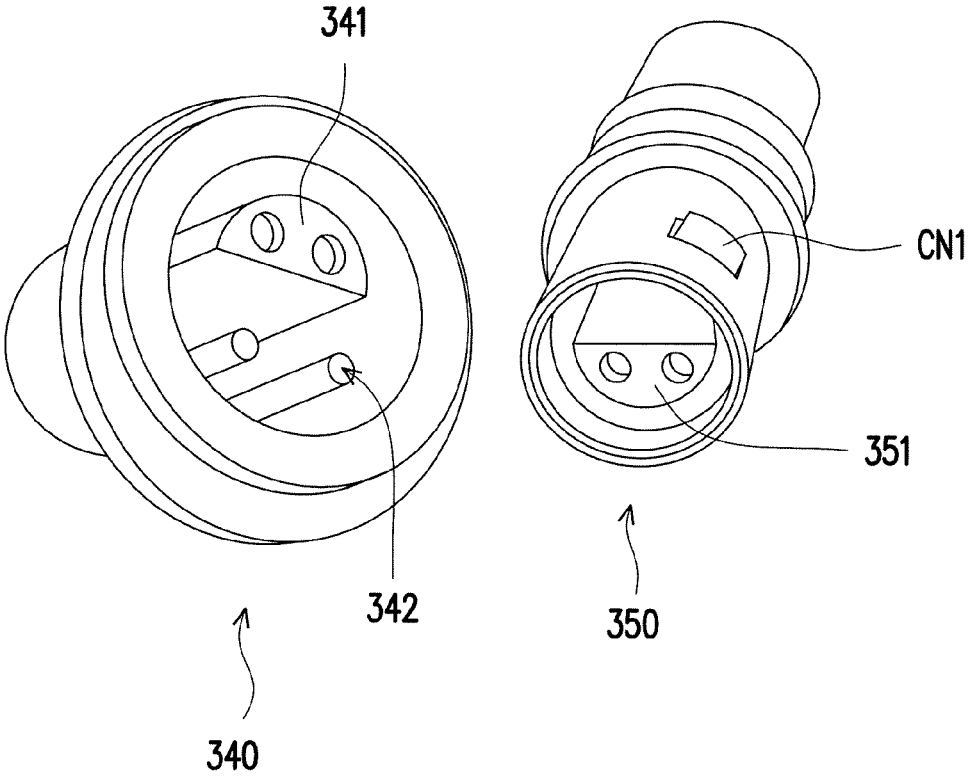
FIG. 3C is a schematic view illustrating another connection of the earphone apparatus according to an embodiment of the invention.

Referring to FIG. 3C, FIG. 3C is a schematic view illustrating another connection of the earphone apparatus according to an embodiment of the invention. The main shell of the earphone apparatus and the expanding shell may be connected to each other through a half-moon connector. As shown in FIG. 3C, a connector 340 and a connector 350 are adjoined to each other. A diameter of the connector 340 is greater than a diameter of the connector 350. On the connector 340, a semicircular structure 341 (a protruding part) and a semicircular structure 342 (a recessed part) are provided. The connector 350 provides structures corresponding to the structures 341 and 342, such as a structure 351 corresponding to the structure 342. Electrodes may be disposed in the structures 341, 342, and 351. When the connector 350 is inserted into the connector 340, the electrodes in the structure 342 and the structure 351 may form electronic connection.

In addition, an engaging structure CN1 is provided on the connector 350. When the connector 350 is inserted into the connector 340, the engaging structure CN1 may be engaged with another corresponding engaging structure (not shown) in the connector 340 by rotating at least one of the connector 350 and the connector 340 to form the connection.

It should be noted that the semicircular connector in the embodiment may be implemented with any semicircular connector that people having ordinary skills in the art are familiar with. The illustration of FIG. 3C merely serves as an example, instead of illustration of a connection required in the embodiment of the present application.

Figure 4:
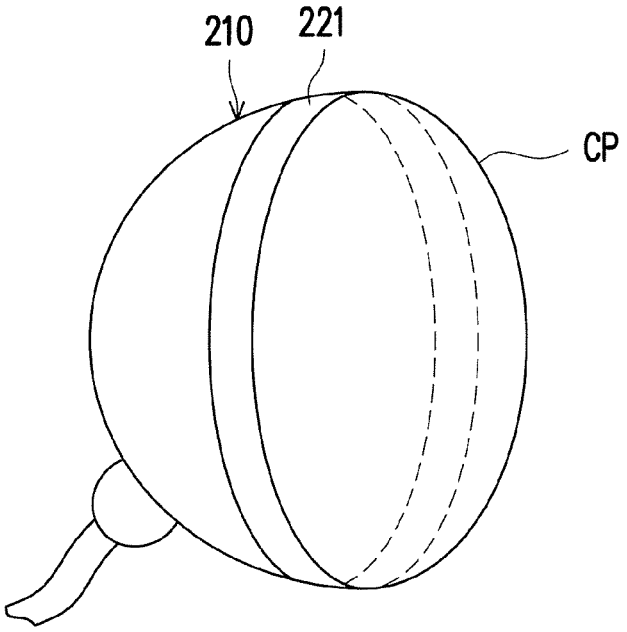
FIG. 4 is a schematic view illustrating an earphone apparatus after removal of an expanding speaker device according to an embodiment of the invention.

Referring to FIG. 4, FIG. 4 is a schematic view illustrating an earphone apparatus after removal of an expanding speaker device according to an embodiment of the invention. Following the embodiment of FIG. 2A, when the expanding speaker device 230 is removed and separated from the earphone apparatus 200, a detachable cover may be further provided in the embodiment of the invention to keep a potential opening on the main shell 210 closed through the connector 221 after the expanding speaker device 230 is removed. Accordingly, after the expanding speaker device 230 is removed, the earphone apparatus 200 may operate normally without exposing internal components that may result in inconvenience of use or damage to the internal components.

Of course, there is no limitation on the shape and the size of the detachable cover CP. Besides, a mesh structure with a plurality of fine openings may be arranged on a surface of the detachable cover CP for the ease of transmission of sound waves.

Figure 5A:
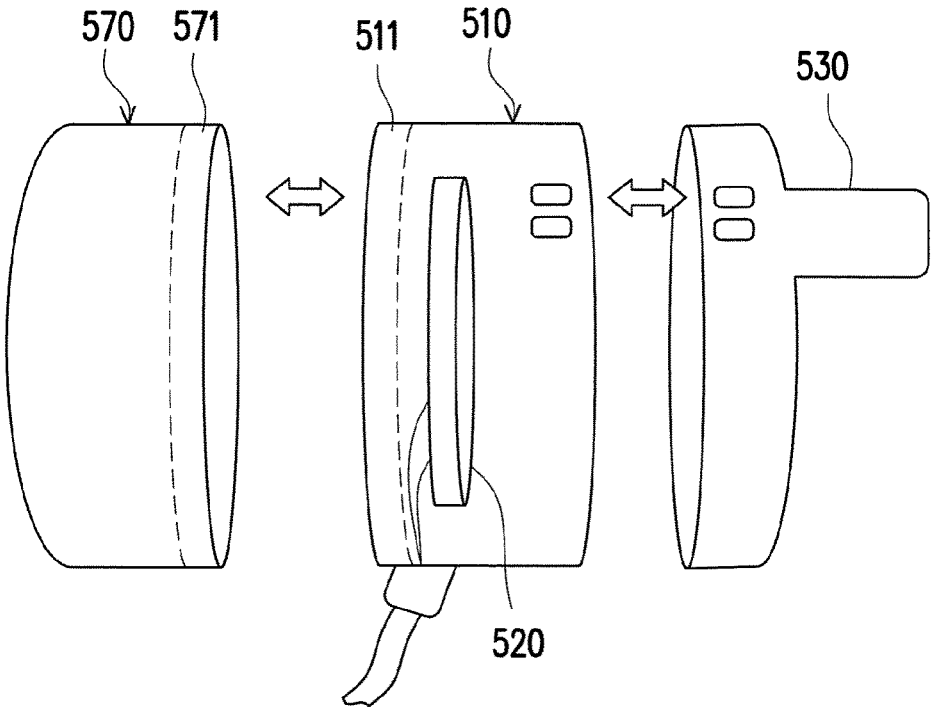
FIG. 5A is a schematic view illustrating an earphone apparatus according to another embodiment of the invention.

Referring to FIG. 5A, FIG. 5A is a schematic view illustrating an earphone apparatus according to another embodiment of the invention. An earphone apparatus 500 includes a main shell 510, an expanding speaker device 530, and an expanding shell 570. The main shell 510 and the expanding speaker device 530 may be assembled and detached based on the descriptions of the previous embodiments. In addition, another connector 511 is disposed on the main shell 510 in the embodiment. In addition, the connector 511 may be disposed at a position of a rear cavity of the main shell 510, whereas a connector of the main shell 510 connecting the expanding speaker device 530 is disposed at a position of a front cavity of the main shell 510. A corresponding connector 571 is disposed on the expanding shell 570. Accordingly, by connecting the expanding shell 570 to the main shell 510, an expanded resonance space is added to the position of the rear cavity of the main shell 510. Consequently, a sound playing quality of the earphone apparatus 500 is further facilitated.

Of course, there is no specific limitation on the shape, the size, and the color of the expanding shell 570 of the embodiment.

Besides, the connectors 511 and 571 may be implemented with various connection devices that people having ordinary skills in the art are familiar with, such as screw-patterned connectors, buckling connectors, or magnetic connectors (i.e., connection structures connected with each other through a magnetic force), and there is no specific limitation on this regard.

Figure 5B:
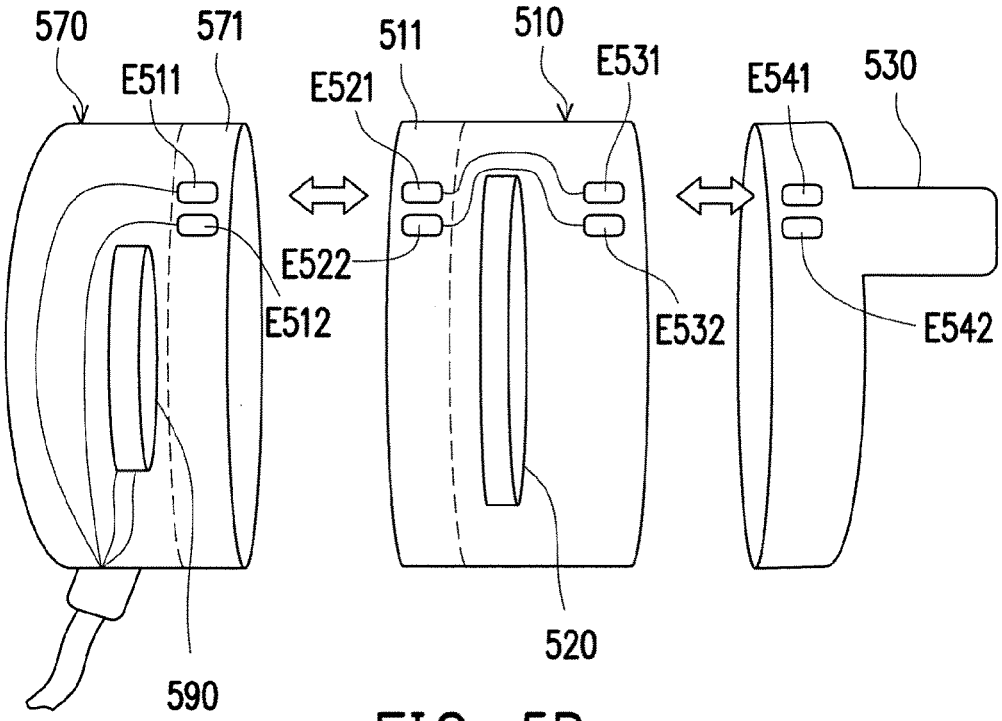
FIG. 5B is a schematic view illustrating another embodiment of the earphone apparatus in the embodiment of FIG. 5A.

Referring to FIG. 5B, FIG. 5B is a schematic view illustrating another embodiment of the earphone apparatus in the embodiment of FIG. 5A. What differs from FIG. 5A in FIG. 5B is that the electrodes E11 and E12 are disposed on the connector 571 of the expanding shell 571, and the signal transmitting wire is connected to the expanding shell 570 and is electronically connected with electrodes E511 and E512 on the expanding shell 570. Electrodes E521 and E522 corresponding to the electrodes E511 and E512 are disposed to the connector 511 on the main shell 510. A speaker device 520 disposed in the main shell 510 is electronically coupled to the electrodes E521 and E522, and when the main shell 510 and the expanding shell 570 are connected, the sound signal is received through the electrodes E511, E512, E521, and E522.

Moreover, electrodes E531 and E532 are disposed in the main shell 510 to respectively correspond to electrodes E541 and E542 on an expanding shell of the expanding speaker device 530 and transmit the sound signal to the expanding speaker device 530 when the electrodes E531 and E532 are respectively electronically connected to the electrodes E541 and E542.

Based on the arrangement in FIG. 5B, a speaker, a microphone, or other devices may be disposed in the front, middle, and rear cavities of the earphone apparatus based on needs. As an example, a speaker device 590 may be further disposed to the expanding shell 570 in the embodiment of the invention to increase the number of speaker device in the earphone apparatus.

Figure 6:
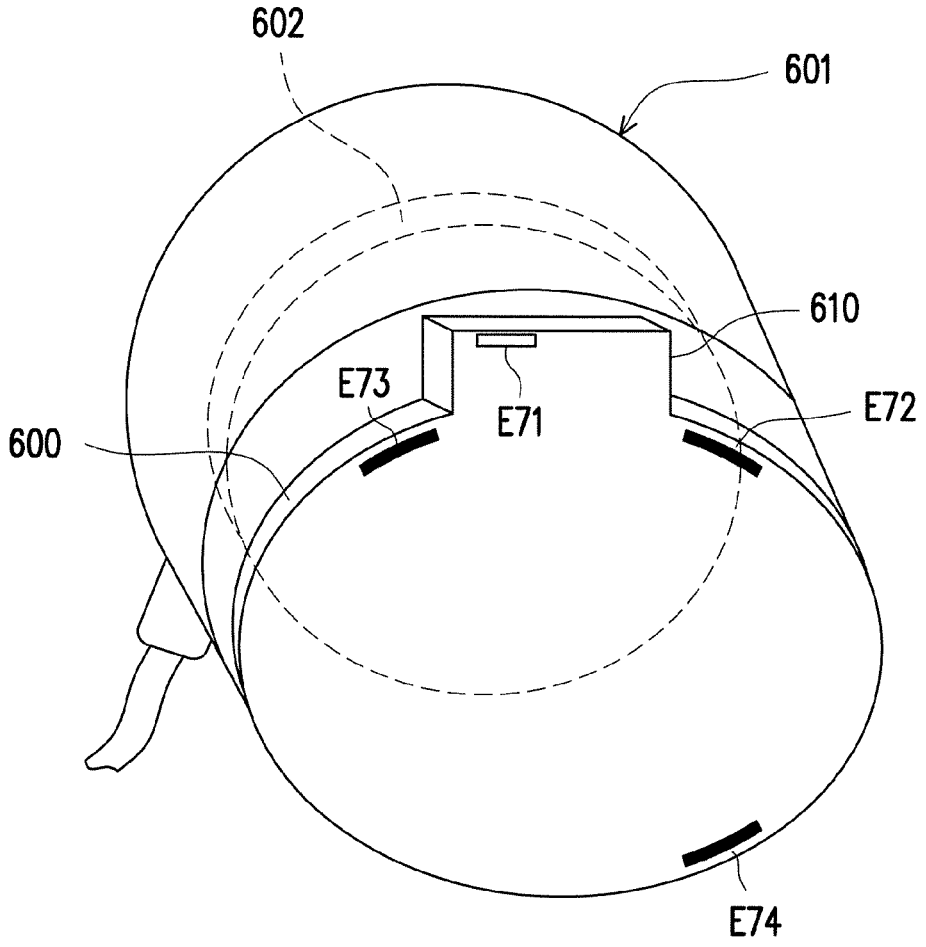
FIG. 6 is a schematic view illustrating an electrode arrangement according to an embodiment of the invention.

Referring to FIG. 6, FIG. 6 is a schematic view illustrating an electrode arrangement according to an embodiment of the invention. In the embodiment, the first electrode and the second electrode may be disposed in the corresponding connectors. In addition, the first electrode and the second electrode may effectively contact each other and form the electronic coupling state when the connectors are connected to each other. In FIG. 6, a connector is disposed at an end of a main shell 601, and a speaker device 602 may be disposed in the main shell 601. The connector 600 may have an alignment structure 610. The alignment structure 610 may have a special shape relative to the connector 600. Electrodes on the connector 600 may be arranged in correspondence with the alignment structure 610. For example, an electrode E71 is disposed in the alignment structure, or electrodes E72 and E73 may be disposed to be adjacent to two sides of the alignment structure 610, or an electrode E74 is disposed at a fixed position opposite to the electrode E73. Of course, electrodes of another connector need to be arranged in a similar manner. Consequently, when the two connectors are connected, the two alignment structures 610 in the two connectors 600 are connected to each other, and the electrodes in a fixed position relation may contact each other to be electronically coupled to each other.

Of course, the shapes and the positions of the connector 600, the alignment structure 610, and the electrodes E71 to E74 in FIG. 6 are merely described as an example, and shall not be construed as limitation of the invention. People having ordinary skills in the art should be able to substantially appreciate the main spirit of the invention with reference to the descriptions of the embodiments of the invention.

In view of the foregoing, the embodiments of the invention provide the detachable expanding speaker device and allow the earphone apparatus to provide applications with a greater functionality. Besides, according to an embodiment of the invention, the user is able to choose the desired function based on the needs. Therefore, the competitiveness of the product is effectively enhanced.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An earphone apparatus, comprising:

at least one sound broadcasting device, comprising:

a main shell, having a first connector;

a plurality of first electrodes, disposed on the first connector;

a speaker device disposed in the main shell and receiving a sound signal through a signal transmitting wire coupled to the first electrodes; and an expanding speaker device, comprising:

an expanding shell, and a second connector detachably connected to the first connector through the second connector, wherein when the second connector is connected to the first connector, the expanding speaker device is electronically connected to the first electrodes and receives the sound signal transmitted by the signal transmitting wire, and the expanding shell and the main shell form a resonance space.

2. The earphone apparatus as claimed in claim 1, wherein the expanding speaker device further comprises:

a plurality of second electrodes, wherein when the second connector is connected to the first connector, the first electrodes are respectively electronically coupled to the second electrodes.

3. The earphone apparatus as claimed in claim 2, wherein the first connector has a first alignment structure, the second connector has a second alignment structure, the first electrodes are disposed in correspondence with the first alignment structure, the second electrodes are disposed in correspondence with the second alignment structure, and when the second connector is connected to the first connector, the first alignment structure corresponds to the second alignment structure to electronically couple the first electrodes to the second electrodes respectively.

4. The earphone apparatus as claimed in claim 2, wherein the first electrodes comprise:

a first positive electrode, receiving a positive part signal of the sound signal; and a first negative electrode, receiving a negative part signal of the sound signal; and the second electrodes comprise:

a second positive electrode, receiving the positive part signal of the sound signal; and a second negative electrode, receiving the negative part signal of the sound signal.

5. The earphone apparatus as claimed in claim 1, wherein the main shell further comprises:

a detachable cover, wherein when the second connector is physically isolated from the first connector, the detachable cover closes the main shell through the first connector.

6. The earphone apparatus as claimed in claim 1, further comprising:

a microphone, disposed in the main shell.

7. The earphone apparatus as claimed in claim 1, wherein a working frequency band of the expanding speaker device is different from a working frequency band of the speaker device.

8. The earphone apparatus as claimed in claim 1, wherein the expanding speaker device is a tweeter or a woofer.

9. An earphone apparatus, comprising:

at least one sound broadcasting device, comprising:

a main shell, having a first connector and a third connector, the third connector disposed on the main shell relative to the first connector;

a plurality of first electrodes, disposed on the first connector;

a speaker device disposed in the main shell and receiving a sound signal through a signal transmitting wire coupled to the first electrodes; and an expanding speaker device, having a second connector and detachably connected to the first connector through the second connector; and an expanding shell, connected to the main shell through the third connector, wherein the expanding shell and the main shell form a resonance space, wherein when the second connector is connected to the first connector, the expanding speaker device is electronically connected to the first electrodes and receives the sound signal transmitted by the signal transmitting wire.

* * * * *